US007546904B2

(12) United States Patent
Wernas

(10) Patent No.: US 7,546,904 B2
(45) Date of Patent: Jun. 16, 2009

(54) SAFETY CLOSING SYSTEM FOR SHAFT DOOR PANEL OF AN ELEVATOR INSTALLATION, AND ELEVATOR INSTALLATION WITH SHAFT DOOR PANEL, WHICH COMPRISES SUCH A SAFETY CLOSING SYSTEM

(75) Inventor: Nijs Wernas, Adligenswil (CH)

(73) Assignee: Inventio AG, Hergiswil NW (CH)

( * ) Notice: Subject to any disclaimer, the term of this patent is extended or adjusted under 35 U.S.C. 154(b) by 466 days.

(21) Appl. No.: 10/916,786

(22) Filed: Aug. 12, 2004

(65) Prior Publication Data

US 2005/0045430 A1 Mar. 3, 2005

(30) Foreign Application Priority Data

Aug. 12, 2003 (EP) ..... 03405590

(51) Int. Cl.

| | |
|---|---|
| ***B66B 13/06*** | (2006.01) |
| ***B66B 13/24*** | (2006.01) |
| ***E05F 1/08*** | (2006.01) |
| ***E05F 1/00*** | (2006.01) |

(52) U.S. Cl. ..... 187/333; 187/340; 16/72; 16/81

(58) Field of Classification Search ..... 49/28, 49/30, 333, 336, 387, 445; 16/72, 81, 216, 16/219; 187/336; 267/73, 74, 174; 188/82.2
See application file for complete search history.

(56) References Cited

U.S. PATENT DOCUMENTS

| | | | | | |
|---|---|---|---|---|---|
| 370,468 | A | * | 9/1887 | Griffing et al. | 16/68 |
| 937,395 | A | * | 10/1909 | Vanderstegen | 16/216 |
| 2,271,527 | A | * | 2/1942 | Peck | 16/217 |
| 3,334,444 | A | | 8/1967 | Hargrove | |
| 3,516,636 | A | * | 6/1970 | Burke | 248/578 |
| 4,003,102 | A | * | 1/1977 | Hawks et al. | 16/72 |
| 4,819,295 | A | * | 4/1989 | Kaftan | 16/72 |
| 5,131,188 | A | * | 7/1992 | Hutchison et al. | 49/404 |
| 5,285,596 | A | * | 2/1994 | Kinsey | 49/404 |
| 6,142,260 | A | * | 11/2000 | Shin | 187/333 |

FOREIGN PATENT DOCUMENTS

| | | |
|---|---|---|
| DE | 196 14 467 | 10/1997 |

* cited by examiner

*Primary Examiner*—Peter M Cuomo
*Assistant Examiner*—Eric Pico
(74) *Attorney, Agent, or Firm*—Fraser Clemens Martin & Miller LLC; William J. Clemens

(57) ABSTRACT

A safety closing system for a shaft door panel of an elevator installation brings the shaft door panel into a closed setting in the absence of an opening force. The safety closing system includes a spring which is stressed in the open setting of the shaft door panel and a drive mass which is subject to gravitational force, the spring and mass being coupled by a flexible tension element with the shaft door panel.

13 Claims, 3 Drawing Sheets

SAFETY CLOSING SYSTEM FOR SHAFT DOOR PANEL OF AN ELEVATOR INSTALLATION, AND ELEVATOR INSTALLATION WITH SHAFT DOOR PANEL, WHICH COMPRISES SUCH A SAFETY CLOSING SYSTEM

BACKGROUND OF THE INVENTION

The present invention relates to a safety closing system for a shaft door panel of an elevator installation.

Elevator installations generally have different kinds of doors, namely on the one hand a car door by which the car is closable and on the other hand shaft doors, wherein a shaft door is present for any and every accessible interruption of the elevator shaft. These doors consist of one or more door panels.

The door panels, especially the shaft door panels, are usually so constructed that they are suspended at corresponding elements of the elevator shaft in the region of the panel upper edge and are guided in the region of the panel lower edge. The panel upper edge is usually constructed so that the movement of the shaft door is a rolling movement, whilst the panel lower edge executes a guided sliding movement or, in a given case, a contactless movement.

In normal operation a shaft door is opened and closed in each instance synchronously with the car door, wherein the shaft door and the car door during the opening and closing process are mechanically connected together by an entrainer coupling. The doors of the elevator installations and, in particular, the shaft doors are for reasons of safety constructed to be self-closing. By that there is to be understood that the shaft doors are equipped with a safety closing system which always brings the door panel into a closed setting when no forces act to bring the door panel into an open setting against the force exerted by the safety closing system or to keep it in a wholly or partly opened open setting. The safety closing system has to be effective not only when the elevator car is disposed outside a floor to which the car is traveling, but also in certain special situations, particularly in the case of failure of the power supply. The safety closing system thus must be actuable by forces that are effective even in the case of power failure and in other emergency situations, for example in the event of a fire.

Conventional elevator installations therefore have shaft doors or shaft door panels with safety closing systems that are mechanically actuated.

A safety closing system, which was frequently used in the past, for a shaft door panel employs, as a drive, a weight or the force which acts, as a consequence of gravity, on a drive mass. The line of action of this force is vertical, whereas the shaft door panel usually has to be moved in a horizontal direction. A deflection is therefore carried out with the help of a roller mechanism and a flexible traction element.

The substantial advantage of such a safety closing system with a vertically arranged drive mass resides in the fact that gravity virtually cannot be reduced or excluded in any case, so that the safety closing system or at least its drive remains effective in every instance.

However, this safety closing system has certain disadvantages intrinsic to the system. Fundamentally, the drive mass, so that it can be effective at all, is a comparatively high mass which firstly has to be accelerated so that the closing process at the start takes place sluggishly. Whereas the force acting on the shaft door panel is—at least without taking account of the friction—constant, the speed at which the shaft door panel is brought into the closed setting increases during the closing process. This has the consequence that the shaft door panel firstly moves only slowly, but at the end of its movement path drops at high speed into the closed setting and is abruptly stopped there. If the undoubtedly present friction is initially taken into consideration, it has to be established that this is greatest at the beginning of the action of the door closing system. Then, in fact, it is necessary to overcome the stiction that is present, for example, between the moved shaft door panel and the non-moved frame parts. If the shaft door panel is in motion, then only a motional friction still has to be overcome, namely a sliding friction or a rolling friction depending on the respective construction of the shaft door panel. So that the shaft door panel can even be brought into movement, the drive mass must thus be of such a size that the stiction can be overcome, because at the moment at which the shaft door panel has to be set in motion there are still no dynamic forces acting thereon, but only the weight of the drive mass. Moreover, the risk exists that the shaft door panel does not move as intended, but jams in whatever manner so that an appropriately higher force has to be employed for movement thereof. A specific disadvantage of a safety closing system with a drive mass can thus be seen in that a deflecting device is required, because the weight always has a vertical effect, whereas the movement of the shaft door panel generally takes place in horizontal direction.

Another frequently used safety closing system employs, as drive for the safety closing system of a shaft door panel, one or optionally several mechanical tension springs. The tension springs in that case are installed in such a manner that they are relieved or adopt their rest position in the closed setting of the shaft door panel. The opening of the shaft door panel takes place against the action of the spring. On opening of the shaft door panel, the tension spring is stretched and thus tensioned. If a force which seeks to bring the shaft door panel into its open setting no longer acts, then the spring relaxes and thereby brings the shaft door panel into its closed setting. Springs can, in fact, have different characteristics, but without special measures the spring force increases with increasing deflection or change in length and reduces with decreasing deflection or change in length. The greatest force thus acts on the shaft door panel when it adopts its open setting, because at this instant the spring is deflected to the greatest extent from its rest position or tensioned. While the shaft door panel moves under the action of the spring to its closed setting, the spring force reduces.

The springs can be so arranged that the line of action of the force exerted by them is horizontal, whereby a deflection by a roller mechanism and a flexible traction element is redundant. Frequently, however, the springs are so installed that the line of action of the force exerted by them is vertical, so that a deflection has to be provided as in the case of safety closing systems with drive masses.

A safety closing system with a spring as drive means has, by comparison with an arrangement which uses a drive mass or a weight as drive, advantages and disadvantages.

One advantage resides in the fact that a spring has a relatively low mass so that it does not have a high level of inertia. It is particularly advantageous that the force exerted by a spring on the shaft door panel is at its greatest when the shaft door panel adopts its open setting and has to be set into motion. During the closing process the spring relaxes and the force exerted on the shaft door panel diminishes. It is thereby achieved that with suitable selection of the spring the stiction acting on the open shaft door panel is overcome in relatively problem-free manner and that the speed of the shaft door panel constantly diminishes the closer it comes to its closed setting. If in the selection of the spring characteristic the motional friction is additionally taken into consideration, then it can be achieved that the speed of the shaft door panel towards the end of its closing movement is almost constant. In this manner it is possible to avoid, without additional braking or damping equipment, the shaft door panel dropping into its closed setting at high speed and having to be abruptly stopped there. A further advantage of a safety closing system with a spring can be seen in that the spring can be installed in such a manner that the line of action of the force exerted by it is horizontal and thereby coincides with the direction of movement of the shaft door panel, so that a corresponding deflecting mechanism is redundant. However, a horizontally installed tension spring which is not too stiff has to be efficiently guided.

The disadvantages of a spring as drive for a safety closing system of a shaft door panel reside in the fact that springs are more susceptible to failure in different ways than drive masses. Due to material deficiencies springs can have characteristics different from those assumed, they can fatigue particularly after over-stretching and they can break after, for example, a defined number of load changes. It is also disadvantageous for their function within a safety closing system that the spring characteristics change in certain circumstances, for example, in dependence on temperature. If no special measures are undertaken, the risk also exists that the shaft door panel does not fully reach its closed setting when these springs are relaxed. However, it can be attempted to avoid this by biasing the springs to a certain extent in the closed setting of the shaft door panel.

In summary, it has to be established that satisfactory safety closing systems for shaft door panels can be produced neither with drive masses nor with springs.

SUMMARY OF THE INVENTION

It is therefore an object of the present invention to propose a safety closing system for a shaft door panel by which the above-mentioned disadvantages of the known safety closing systems are avoided. It is additionally an object of the present invention to create an elevator installation with a safety closing system improved in that way.

According to the present invention the new safety closing system has not only a drive mass subject to gravity, but also a spring in order to move a shaft door panel from its open setting into its closed setting. The drive mass and the spring in that case cooperate at least for a time, i.e. they act simultaneously and in the same sense. There is thus obtained a safety closing system in which the advantages of the safety closing systems with drive masses and the advantages of safety closing systems with springs are combined.

This safety closing system has the most significant advantages of safety closing systems which have only springs, but it is safer since even in the case of a failure of the spring the closing of the shaft door panel is guaranteed. However, a precondition for that is that the drive mass is selected to be sufficiently large in order to overcome, without the assistance of a spring force, the stiction of the shaft door panel when this is at rest and thus partly or entirely open and, in addition, the forces which may obstruct closing.

In the case of the new safety closing system it is not necessary, depending on the respective form of embodiment, to bias the spring in its non-tensioned state, i.e. when the shaft door panel is closed, since the drive mass is capable in every case of bringing the shaft door panel perfectly into the closed setting. The installation space for the spring is thereby reduced.

A particularly advantageous safety closing system according to the present invention has, as a spring, a helical spring, preferably a tension spring.

A helical spring can be arranged either around the weight or in a vertical interruption of the weight, in either case so that a guidance comes into being between the spring and the weight. This is a particular advantage of the arrangement according to the present invention, because the otherwise necessary guidance for the weight is superfluous.

In a preferred construction the new safety closing system comprises a tension spring which is fastened at its lower end to the elevator shaft and at its upper end to a first end or run of a flexible traction element. Cables, ropes or belts, for example, come into question as flexible traction element. The second end or run of the flexible traction element is fastened to the shaft door panel. The flexible traction element runs over a vertical/horizontal deflecting arrangement, for example with deflecting rollers. The traction element runs around the deflecting rollers through 90°. It runs from the deflecting arrangement in the vertical direction to the fastening point of the spring and the drive mass and in the horizontal direction to the fastening point of the shaft door panel. The flexible traction element and the deflecting arrangement together form a deflecting mechanism. The deflecting mechanism obviously has to be differently conceived if a vertically displaceable shaft door panel should be concerned.

The above-described deflecting mechanism can comprise a further, horizontal/horizontal deflecting arrangement. The flexible traction element runs from the deflecting roller mechanism horizontally to the second deflecting arrangement, is there deflected through 180° and then runs, always still horizontally, but in opposite sense, to the fastening point of the shaft door panel. In the case of such an arrangement the shaft door panel is remote from the drive mass and spring of the safety closing system. Without such a second deflecting arrangement the shaft door panel moves towards the drive mass and the spring whilst it is moving to its closed setting.

Instead of a helical spring, which is fastened together with the weight to one end of the flexible traction element, there can also be used a spring which acts with essentially the same effect on the shaft of a deflecting roller mechanism.

As described further above, one of the disadvantages of conventional safety closing systems with drive masses consists in that the shaft door panel arrives at high speed in its closed setting and thereby causes severe impacts on the frame or the elevator shaft. This disadvantage can be sufficiently reduced by the new safety closing system. In particular, thanks to the action of the spring, a comparatively small weight can be used so that the mentioned impacts are kept within limits.

In order to reduce such impacts as far as possible, the smallest drive masses, i.e. a minimum mass, should be selected which in the case of emergency still ensures closing of the shaft door panel even in the event of failure of the spring.

This drive mass can advantageously be combined with a spring which on opening of the shaft door panel is stressed only when the shaft door panel is already partly opened or in a middle setting. This has the effect that on closing of the shaft door panel the force of the spring acts only at the outset, in particular until the spring is relaxed again. At the end of the closing process the weight of the drive mass still acts on the shaft door panel as an accelerating force. The spring thus acts specifically in that period of time in which it is needed most urgently, namely at the beginning of the closing process where the stiction has to be overcome and, in a given case, the shaft door panel has to be released from being jammed. The, so-to-speak, "damaging" action of the spring at the end of the closing process is avoided. This damaging action would consist in the speed of the shaft door panel at the end of the closing movement increasing more than happens by the drive mass alone.

In order to completely avoid impacts on hitting, in the closed setting, against the frame, the new safety closing system can comprise a spring arrangement which in the last phase of the closing of the shaft door panel acts as a brake or buffer or as a damper.

A particular advantage of the new safety closing system resides in the fact that it can be used for subsequent fitting to existing elevator installations, the door panels of which have either only weights or only springs.

It may be further mentioned that the new safety closing system can obviously be used not only for shaft door panels, but also for other doors.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
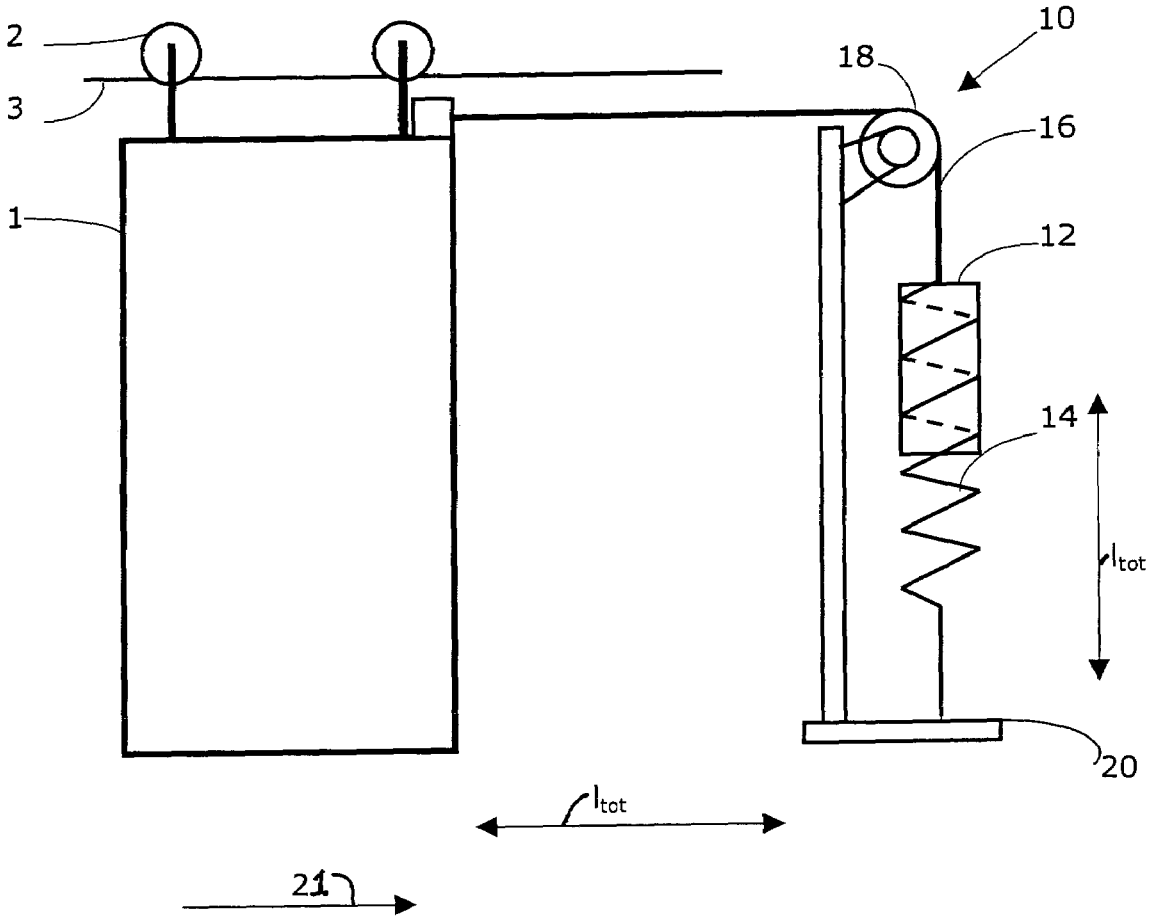
FIG. 1 shows a shaft door panel with a safety closing system according to the invention in a schematic illustration.

FIG. 1 shows a shaft door panel 1 in its open setting, which panel is suspended at a rail 3 by way of a roller arrangement 2 and is horizontally displaceable relative to the rail 3. The rail 3 forms a component of a door frame arrangement, which is not further illustrated, of an elevator shaft.

The shaft door panel 1 is equipped with a safety closing system 10. The safety closing system 10 comprises a drive mass 12 and a spring 14 as a drive means. The spring 14 is a helical spring in the present example of a first embodiment. Other types of springs and/or several springs can also be used. The drive mass 12 and the spring 14 are fastened to the end of a vertical run of a flexible traction element 16. The flexible traction element 16 runs over a vertical/horizontal deflecting mechanism 18. The free end of the horizontal run of the flexible traction element 16 is connected with the door panel 1.

The spring 14 is, as already described, coupled by its upper end with the flexible traction element 16. The lower end of the spring 14 is fixed to a stationary fastening body 20, for example to the shaft wall.

The spring 14 is a tension spring in the present example of the first embodiment. It adopts its relaxed position when the shaft door panel 1 is disposed in its closed setting and it adopts its maximally tensioned position when the shaft door panel is, as illustrated in FIG. 1, disposed in its open setting.

If the shaft door panel 1 opens under the action of an opening force, then it displaces against the direction of an arrow 21, in total over a path $l_{tot}$ indicated by a double headed horizontal arrow. On opening of the shaft door 1 the drive mass 12 and the upper end of the spring 14 are displaced vertically upwardly into the position shown in FIG. 1 and, in particular, substantially over the path $l_{tot}$, indicated by a double headed vertical arrow, if the elongation of the flexible traction element 16 due to the forces acting thereon is disregarded. Since the lower end of the spring 14 is stationary, the spring 14 is elongated over the path $l_{tot}$ and is thereby tensioned. The opening energy must be at least as large as the sum of the energies, which are required for moving the drive mass 12 over the path $l_{tot}$, for tensioning the spring 14 and for overcoming the friction which is present.

As soon as the opening force which keeps the shaft door panel 1 in its open setting is no longer present, the weight of the drive mass 12 and the force of the spring 14 so act by way of the flexible traction element 16 on the shaft door panel 1 that this is displaced in the direction of the arrow 21 into its closed setting. So that this is possible, the weight of the drive mass 12 and the spring force 14 must together be greater than the sum of the friction in the safety closing system itself, the friction between the shaft door panel 1 and a frame arrangement and, in a given case, other forces which seek to prevent a closing movement.

Figure 2A:
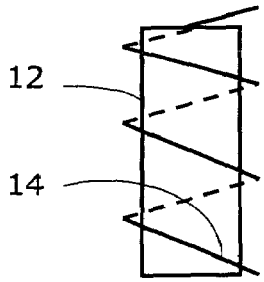
FIG. 2A is a schematic illustration of a drive mass and a spring of the safety closing system of FIG. 1 in a first embodiment.

FIG. 2A shows how the spring 14, constructed as a helical spring, can be arranged around the drive mass 12. There is thereby obtained a mutual guidance for the drive mass 12 and the spring 14. The spring 14 is here illustrated as a tension spring in a relaxed state.

Figure 2B:
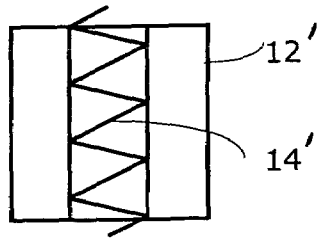
FIG. 2B is a schematic illustration of a drive mass and a spring of the safety closing system of FIG. 1 in a second embodiment.

In addition, in the case of an arrangement according to FIG. 2B in which the spring 14' is disposed in a bore of the drive mass 12', there is obtained a mutual guidance of the drive mass 12' and the spring 14'. The spring 14' is here illustrated as a tension spring in a relaxed state.

Figure 2C:
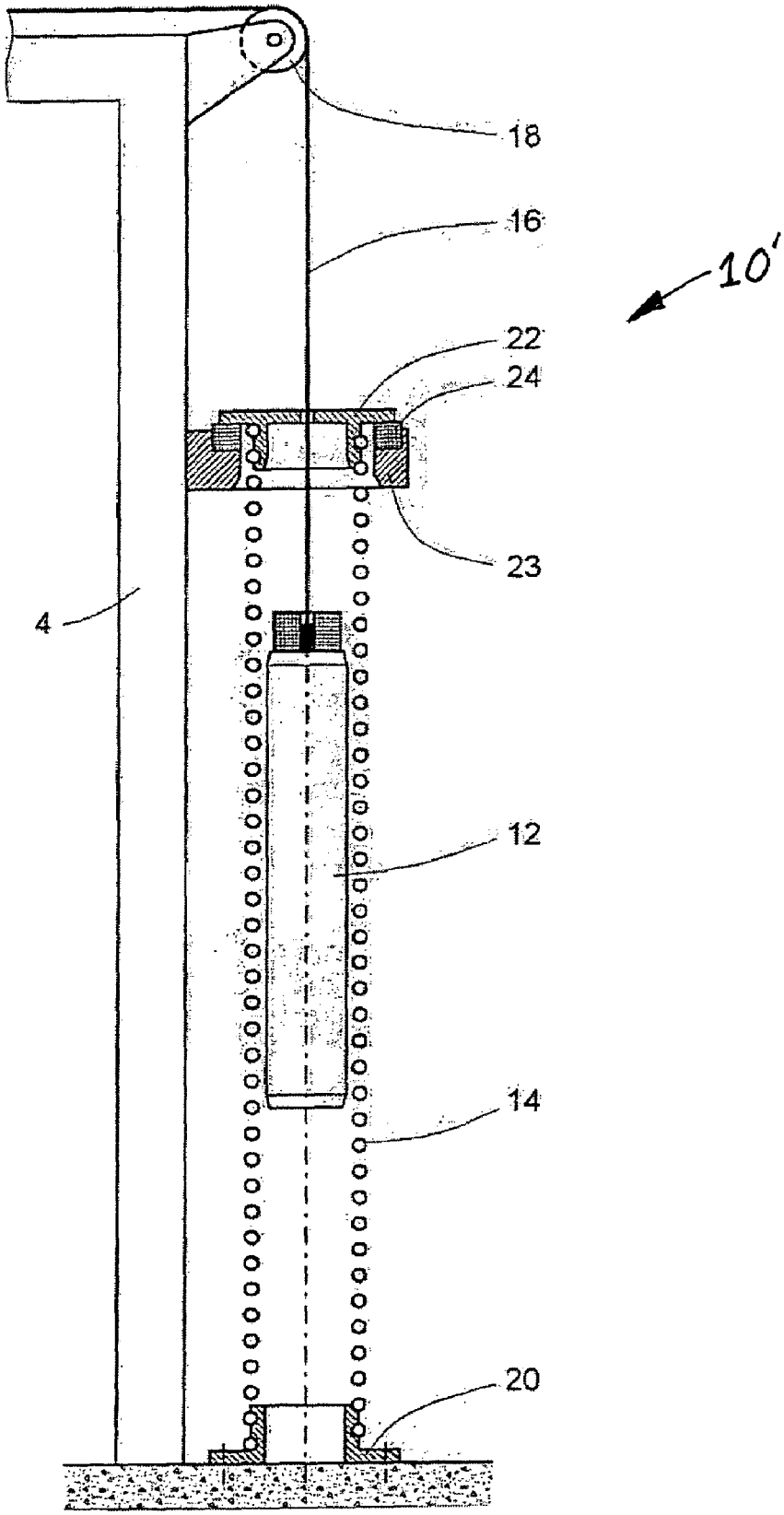
FIG. 2C is a schematic illustration of an alternate embodiment of the safety closing system according to the present invention, in which the spring acts only over part of the entire path of the drive mass.

An alternate embodiment of a safety closing system 10' according to the present invention is illustrated in FIG. 2C. There is shown a door post 4 to which the deflecting roller 18, over which the flexible traction element 16 runs, is fastened. The drive mass 12 is fastened to the flexible traction element 16. The spring 14, which surrounds the drive mass 12, extends between the lower fastening body 20 and an upper spring fastening element 22, which is displaceable in a vertical direction. The spring fastening element 22 is supported on a fixed abutment 23 and so arranged that it is movable upwardly by the drive mass 12 out of the position shown in FIG. 2C. If the shaft door panel, which is not illustrated here, opens, then the drive mass 12 is raised, wherein initially the spring 14 is not tensioned. When the drive mass 12 during its upward movement reaches the abutment 23, it entrains the spring fastening element 22 therewith in an upward direction. The spring 14 is thus stretched and thereby tensioned. The flexible traction element 16 moves upwardly, over the deflecting mechanism 18 and to the left during opening of the shaft door panel. On closing of the shaft door panel initially not only the drive mass 12, but also the relaxing spring 14 act in such a manner that the flexible traction element 16 is moved to the right, over the deflecting mechanism 18 and downwardly. As soon as the spring fastening element 22 has reached the abutment 23 only the drive mass 12 still acts, but not the spring 14, on the flexible traction element 16 and thus on the shaft door panel. The spring 14 thus acts only during a first part of the closing process. Advantageously, a resilient body 24 is arranged between the spring fastening element 22 and the abutment 23.

As shown in FIGS. 2A and 2C, the spring 14 forms an internal vertical guideway for the drive mass 12. As shown in FIG. 2B, the spring 14' forms an external vertical guideway for the drive mass 12'.

Figure 3A:
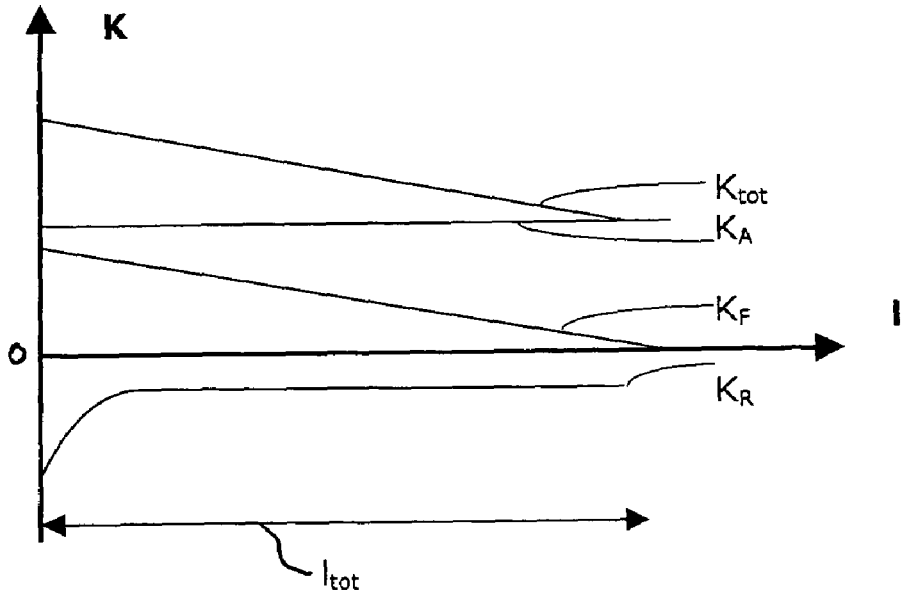
FIG. 3A is a plot of the forces exerted by the drive mass and the spring as well as the friction force verses displacement in the case of the safety closing system according to FIG. 1.

FIG. 3A shows a plot of force K versus displacement travel 1 for the embodiment shown in FIG. 1. A force $K_A$, which is exerted by the drive mass 12 on the end of the vertical run of the flexible element 16 and which equals the drive mass multiplied by a gravitational constant "g", is plotted as a function of the displacement travel 1. The end of the horizontal run of the flexible element 16 is connected with the door panel 1 to be closed. Not taken into account at the moment are other forces on the flexible element 16, particularly friction forces which act on the shaft door panel 1.

The force $K_A$ is constant over the length l and also over time. If only the force $K_A$ were effective, then this would have the consequence of an acceleration of the flexible element 16 which linearly increases over time. The path covered would increase with the square of the time.

FIG. 3A further shows a force $K_F$, which is exerted on the vertical run of the flexible element 16, as a function of the displacement travel 1 or the spring deflection. The end of the horizontal run of the flexible element 16 is connected with the door panel 1 to be closed. The spring force $K_F$ is at a maximum when the spring 14 is tensioned to a maximum degree, i.e. when the shaft door panel 1 adopts its open setting and the spring 14 is extended by $l_{tot}$. The spring 14 acts continuously, even if with decreasing force, while the shaft door panel 1 moves towards its closed setting. The speed, which is caused by the force of the spring 14, of the flexible traction element 16 thus continuously decreases, but degressively during the closing movement.

A total closing force $K_{tot}$, exerted by the drive mass 12 and the spring 14 together, over the length l is similarly illustrated in FIG. 3A. The speed of the flexible traction element 16 and thus the shaft door panel 1 continuously increases, even if degressively, until the shaft door panel has reached its closed setting, when only the drive mass 12 and the spring 14 were effective.

Figure 3B:
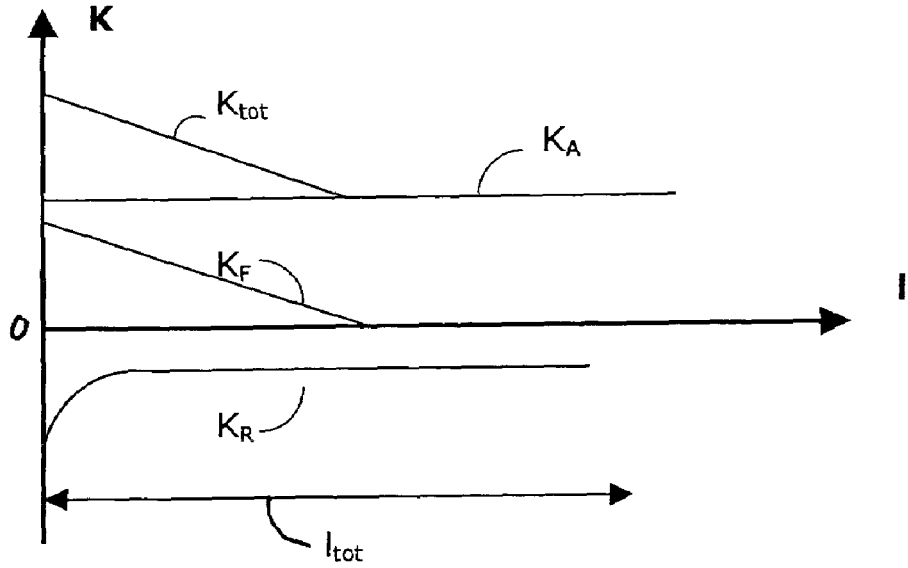
FIG. 3B is a plot of the forces exerted by the drive mass and the spring as well as the friction force versus displacement in the case of the safety closing system according to FIG. 2C.

FIG. 3B shows a plot of the force relationship in the case of the arrangement according to FIG. 2C, i.e. if there is used, instead of a spring which acts over the entire displacement path $l_{tot}$, a spring which acts only when the shaft door panel 1 is disposed in the vicinity of its closed setting. The force $K_F$ exerted by such a spring assists the force $K_A$ of the drive mass 12 to set the shaft door panel 1 in motion out of its open setting. If the shaft door panel 1 has then approached its closed setting, then only the force $K_A$ of the drive mass 12 still acts, whereas the force $K_F$ of the spring 14 no longer acts. In that case the speed of the traction element 16 and of the shaft door panel 1 reduces again, but the increase is smaller than if also the spring 14 were effective.

In the following there are now also taken into consideration the forces which oppose the closing force and which were hitherto disregarded. These forces are composed of an air resistance, a total friction $K_R$ and, in a given case, blocking forces which act on the shaft door panel 1 when this has jammed.

The air resistance can be disregarded in the present conditions.

The total friction comprises the friction of the safety closing system, i.e. essentially the friction of the deflecting mechanism 18, and the friction of the shaft door suspension. The friction of the deflecting mechanism 18 is considered to be negligible. The friction of the shaft door suspension is substantially the friction between the rollers 2 of the shaft door panel and the rail 3 of the frame arrangement 1. Added thereto is the friction of the shaft door panel usually guided in the lower region.

In the present embodiments the friction of the displacing shaft door suspension is a rolling friction. Depending on the respective kind of suspension it can also be a sliding friction. The rolling friction is, with otherwise identical conditions, basically always smaller than the sliding friction, but a suspension with a rolling displacement of the shaft door panel is preferred. The rolling friction can be assumed to be a constant. It is essentially dependent on the mass of the shaft door panel 1 and the coefficients of friction, which in turn depend on the materials of the constructional elements moved relative to one another. Speed can similarly have an influence on the rolling friction, but in the present case can be regarded as negligible. The friction $K_R$ acting during displacement of the shaft door panel 1, as illustrated in FIGS. 3A and 3B, is considered to be constant.

As long as the shaft door panel 1 is at rest in its open setting, there is no rolling friction or sliding friction, but a stiction which, with otherwise identical conditions, is greater than the rolling friction or the sliding friction. Accordingly, the closing force acting at the outset and required to set the shaft door panel 1 in motion has to be greater than the closing force by which the already moving shaft door panel 1 is further moved, so that it exceeds the threshold value of the stiction. The stiction acting at the beginning of the closing process is also shown in FIGS. 3A and 3B as an initial upwardly curved portion of the total friction $K_R$, wherein the path along which it actually acts is in reality virtually insignificantly short.

It may be noted that in general it is desired to avoid friction forces as far as possible. In the present case, however, the friction also has an advantage. In particular, it reduces—and indeed over the entire travel of the shaft door panel 1—the closing force which acts on the shaft door panel 1. The movement of the shaft door panel 1 is, in fact, thereby hindered at the outset, but the acceleration of the shaft door panel is also kept within limits so that an undesired high speed of this shaft door panel 1 at the end of its travel is prevented.

The closing force also has to overcome those forces which keep the shaft door panel 1 in a jammed position. These forces in general have to be determined experimentally if no empirical values for such are present. The degree of wear of the elevator installation and the prevailing temperature can in that case play a role.

It was already mentioned several times that a too-high speed of the shaft door panel in the end phase of its closing movement is not desired. Such a high speed does not occur if the force acting on the shaft door panel remains limited. This can be achieved in that a spring is selected which does not act in the end phase of the closing movement, as shown in FIG. 3B, or a spring which acts against the force of the drive mass. Another possibility is that the friction force hindering the closing movement is relatively large. If, for example, the resultant of the total closing force $K_{tot}$ and the opposing forces, particularly the total friction force $K_R$, were overcome, then the speed of the shaft door panel 1 remains substantially constant, which would favor a constantly increasing speed. In the case of use of the flexible traction element 16 for transmission of the forces between the drive mass 12 and the spring 14 on the one hand and the shaft door panel 1 on the other hand, however, the braking action has to be metered in such a manner that the traction element at all times is under tensile stress at both ends.

The above description relates to a basic sequence of the closing process in an elevator installation with the new safety closing system according to the present invention, wherein particular reference is made to critical points. The exact movement course of the new safety closing system is calculated in accordance with laws of mechanics known to every expert. Numerical details with respect to the drive masses and springs employed as well as with respect to the arising forces, accelerations and speeds are not made, since such are dependent on the dimensions and material constants of the elements of the elevator installation and the safety closing system. Instead of computer calculation, the desired values can also be determined entirely or partly in experimental manner, wherein in general the starting point can be from known data of similar elevator installations or safety closing systems, which have, however, only a drive mass or only a spring.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A safety closing system for a shaft door panel of an elevator installation, in order to bring the shaft door panel into a closed setting in the absence of an opening force, the safety closing system comprising:

a helical tension spring adapted to be stressed in an open setting of the shaft door panel;

a drive mass subject to gravitational force; and a traction element coupling said spring and said drive mass with the shaft door panel, wherein said helical tension spring forms a vertical guideway for said drive mass.

2. The safety closing system according to claim 1 wherein said spring is arranged around said drive mass to forms said guideway in order to ensure guidance between said drive mass and said spring.

3. The safety closing system according to claim 1 wherein said spring is positioned in a bore of said drive mass forming said guideway in order to ensure guidance between said drive mass and said spring.

4. The safety closing system according to claim 1 wherein said fraction element is a flexible traction element and including a deflecting mechanism cooperating with said flexible traction element, said flexible traction element having one end coupled with said drive mass and said spring and another end fastened to the shaft door panel, said deflecting mechanism providing a vertical/horizontal deflecting arrangement for said flexible fraction element.

5. The safety closing system according to claim 4 wherein said deflecting mechanism permits the shaft door panel to move horizontally relative to said drive mass during movement of the shaft door panel into the closed setting and the open setting.

6. The safety closing system according to claim 1 wherein said spring adopts a relieved position when the shaft door panel is disposed between the open setting and a middle setting in which the shaft door panel is partly closed.

7. The safety closing system according to claim 1 wherein said spring does not apply a force to the shaft door panel when the shaft door panel is disposed between a partially closed middle setting and the closed setting.

8. The safety closing system according to claim 1 wherein said spring applies a spring force ($K_F$) opposing a drive mass force ($K_A$) applied by said drive mass when the shaft door panel is disposed between a partially closed middle setting and the closed setting.

9. The safety closing system according to claim 1 including a fixed abutment, a fastening element attached to an end of said spring and engaging said abutment, whereby during opening movement of the shaft door panel, said drive mass contacts said fastening element and moves said fastening element away from said abutment in opposition to a force applied by said spring.

10. An elevator installation comprising:

a shaft door panel mounted for horizontal movement between a closed setting and an open setting:

a helical tension spring connected to said shaft door panel and being stressed in the open setting of said shaft door panel; and a drive mass subject to gravitational force and connected to the shaft door panel for urging said shaft door panel to the closed setting, wherein said helical tension spring forms a vertical guideway for said drive mass.

11. The elevator installation according to claim 10 wherein said spring is a helical spring arranged around said drive mass or positioned in a bore of said drive mass forming said guideway to ensure mutual guidance between said drive mass and said spring.

12. The safety closing system according to claim 10 including a fixed abutment, a fastening element attached to an end of said spring and engaging said abutment, whereby during opening movement of said shaft door panel, said drive mass contacts said fastening element and moves said fastening element away from said abutment in opposition to a force applied by said spring.

13. A safety closing system for a shaft door panel of an elevator installation, in order to bring the shaft door panel into a closed setting in the absence of an opening force, the safety closing system comprising;

a spring which adapted to be stressed in an open setting of the shaft door panel;

a drive mass subject to gravitational force;

a traction element coupling said spring and said drive mass with the shaft door panel;

a fixed abutment; and a fastening element attached to an end of said spring and engaging said abutment, whereby during opening movement of the shaft door panel, said drive mass contacts said fastening element and moves said fastening element away from said abutment in opposition to a force applied by said spring.

* * * * *